US010662773B2

(12) United States Patent
Fiebing et al.

(10) Patent No.: US 10,662,773 B2
(45) Date of Patent: May 26, 2020

(54) HYDRAULIC AXIAL PISTON UNIT WITH CENTRAL FIXED HOLD DOWN DEVICE

(71) Applicant: Danfoss Power Solutions GmbH & Co. OHG, Neumünster (DE)

(72) Inventors: Anja Fiebing, Jevenstedt (DE); Niels Christophersen, Stolk (DE); Carsten Fiebing, Jevenstedt (DE)

(73) Assignee: Danfoss Power Solutions G.M.B.H. & Co. OHG, Neumunster (DE)

( * ) Notice: Subject to any disclaimer, the term of this patent is extended or adjusted under 35 U.S.C. 154(b) by 155 days.

(21) Appl. No.: 15/815,859

(22) Filed: Nov. 17, 2017

(65) Prior Publication Data

US 2018/0142553 A1 May 24, 2018

(30) Foreign Application Priority Data

Nov. 24, 2016 (DE) ..... 10 2016 223 307

(51) Int. Cl.

| | |
|---|---|
| ***F15B 3/00*** | (2006.01) |
| ***F01B 3/00*** | (2006.01) |
| ***F04B 1/324*** | (2020.01) |
| ***F03C 1/40*** | (2006.01) |
| ***F03C 1/06*** | (2006.01) |
| ***F04B 1/2092*** | (2020.01) |

(52) U.S. Cl.

CPC ..... *F01B 3/0073* (2013.01); *F01B 3/0041* (2013.01); *F01B 3/0088* (2013.01); (Continued)

(58) Field of Classification Search

CPC ..... F01B 3/0088

See application file for complete search history.

(56) References Cited

U.S. PATENT DOCUMENTS 3,191,543 A 6/1965 Hann et al.
3,241,495 A * 3/1966 Diedrich ..... F01B 3/0067 91/507

(Continued)

FOREIGN PATENT DOCUMENTS

AT 252678 B 3/1967
CN 103069161 A 4/2013

(Continued)

OTHER PUBLICATIONS

Chinese Office Action and English Translation for Serial No. 201711170108.5 dated Dec. 26, 2018.

*Primary Examiner* — F Daniel Lopez

(74) *Attorney, Agent, or Firm* — McCormick, Paulding & Huber PLLC

(57) ABSTRACT

Hydraulic axial piston unit (1) of the swashplate construction type having a drive shaft (2) adapted to drive or be driven by a cylinder block (4). The cylinder block comprises a plurality of cylinder bores (6), in which several pistons (8) are moveable in general along the rotational axis (10) of the drive shaft (2) and relative to the cylinder bores (6). First ends of the pistons (8) protrude outside of the cylinder bores (6) and are slidable fixed by means of slippers (14) to a swashplate (16). The slippers (14) are hold down in a sliding manner on a sliding surface (18) of the swashplate (16) by means of a slipper hold down ring (20) arranged parallel to the sliding surface (18). The slipper hold down ring (20) is in a sliding contact with its radial inner surface (22) with a matching surface (26) on a guide ball (24) rotationally fixed on the drive shaft (2) and axially moveable in direction of the rotational axis (10) relative to the cylinder block (4) against resilient forces of springs (28) characterized in that a mounting ring (30) is attached to the cylinder block (4) in (Continued)

order to limit the axial movement of the guide ball (24) towards the cylinder block (4).

8 Claims, 2 Drawing Sheets

(52) U.S. Cl.
CPC ..... *F03C 1/0673* (2013.01); *F03C 1/0686* (2013.01); *F04B 1/2092* (2013.01); *F04B 1/324* (2013.01); *F03C 1/0671* (2013.01)

(56) References Cited

U.S. PATENT DOCUMENTS

| | | | | |
|---|---|---|---|---|
| 3,274,897 | A | 9/1966 | Reinke | |
| 3,803,985 | A * | 4/1974 | Maistrelli | F01B 3/007 91/488 |
| 4,111,103 | A | 9/1978 | Mauch | |
| 4,478,134 | A | 10/1984 | Kawahara et al. | |
| 2013/0327208 | A1 | 12/2013 | Ohno et al. | |

FOREIGN PATENT DOCUMENTS

| | | | |
|---|---|---|---|
| CN | 103184990 | A | 7/2013 |
| DE | 1703403 | B1 | 12/1971 |
| DE | 1453639 | A1 | 2/1972 |
| DE | 2616985 | A1 | 11/1976 |
| DE | 10 2012 110 853 | A1 | 5/2014 |
| GB | 1127293 | | 9/1968 |
| JP | 08086273 | A | 4/1996 |
| JP | 2004084660 | A | 3/2004 |
| JP | 2014-95384 | A | 5/2014 |

* cited by examiner

HYDRAULIC AXIAL PISTON UNIT WITH CENTRAL FIXED HOLD DOWN DEVICE

CROSS-REFERENCE TO RELATED APPLICATION

This application claims foreign priority benefits under U.S.C. § 119 to German Patent Application No. 10 2016 223 307.6 filed on Nov. 24, 2016, the content of which is hereby incorporated by reference in its entirety.

TECHNICAL FIELD

The present invention relates to a hydraulic axial piston unit of the swashplate construction type, preferably a hydraulic axial piston unit of the variable displacement type. The present invention relates in particular to a hold down device holding down the piston slippers on the swashplate.

BACKGROUND ART

For setting the displacement of a hydraulic axial piston unit of the above mentioned type—fixed or variable—an inclined or inclinable swashplate is used. On this non-rotating inclined, swashplate a plurality of working pistons are mounted slide-able in piston slippers which rotate circumferentially on the swashplate. The pistons are movable reciprocally in cylinder bores relative to a cylinder block. Therewith the cylinder block is able to rotate, driving or being driven by a drive shaft defining the rotational axis of the hydraulic axial piston unit. In a preferred case of a variable adjustable hydraulic axial piston unit the swashplate is pivot-able in order to adjust the stroke of the pistons within the cylinder bores. For preventing the slippers from lifting-off from the swashplate a hold down device is provided to hold down the piston slippers in a sliding manner on a sliding surface of the swashplate. Thereby the slipper hold down device is in contact with a radial inner surface with a corresponding matching surface of a guide ball rotatable but fixed, however axially moveable relative to the drive shaft and the cylinder block. Usually the guide ball is mounted pre-stressed in axial direction such that the guide ball presses the hold down device of the piston slippers towards the sliding surface of the swashplate.

At standstill of the hydraulic axial piston unit the piston slippers—in the following only "slippers"—are pressed by the pre-stressing forces of the guide ball on the swashplate thereby having physical contact with the sliding surface of the swashplate. With a rise in the rotational speed of the cylinder block the slippers are lifted-off from the sliding surface, wherein the lifting-off forces which lift-off the slippers from the sliding surface of the swashplate increase with the rotational speed due to the gyroscopic effect. Naturally, the sliding contact between the slippers and the sliding surface of the swashplate must be lubricated in order to reduce friction and wear and to provide a proper function of the hydraulic axial piston unit. In a preferred embodiment the sliding bearing between the slippers and the swashplate is designed as a hydrodynamic bearing which is fed by the working fluid through central bores within the pistons and slippers. In other embodiments this sliding bearing is lubricated by leakage fluid or an oil sump in which the driving unit of the hydraulic axial piston unit rotates.

Irrespective of the kind of the slide bearing, a minimum gap between the sliding surfaces of the slippers and the swashplate must be provided, especially in the case of a hydrodynamic bearing. This means that when the rotation of the driving unit starts the lift-off forces lifting-off the slippers from the sliding surface counteracts against the guide ball forces pressing the slippers onto the sliding surface of the swashplate. These lifting-off forces should already enable low friction conditions at low rotational speeds and should avoid wear and damages to the involved parts and furthermore, should allow a quick response in the rise of the rotational speed of the driving unit. These aspects are favoured when the guide ball forces are low such that friction between the slippers and sliding surface decreases rapidly when the driving unit of the hydraulic axial piston unit starts to rotate.

On the other hand the guide ball pressing forces on the hold down device have to be relatively high if the driving unit of the hydraulic axial piston unit is at high rotational speeds, as the lifting-off forces increase with rising rotational speeds of the driving unit. If at high rotational speeds the pre-stressing forces are too low, the hold down device allows the slippers to lift-off of the sliding surface of the swashplate too much such that the gap between the slippers and the sliding surface is getting too big for a proper sliding bearing. Furthermore, in hydraulic axial piston units with hydrodynamic bearings if the gap between the slippers and the sliding surface is too big the leakage between the slippers and the swashplate increases to an undesired manner.

Furthermore, in the case that the slippers are mounted hydro-dynamically on the sliding surface of the swashplate the lifting-off forces increase with the working pressure too, i.e. with high work load conditions on the driving unit the distance/the gap between the slippers and the sliding surface increases with the increasing working pressure. Therefore the hold down forces of the guide ball must be high enough to maintain the gap small enough for the proper operation of a hydrodynamic bearing and hence to avoid excess of leakage through this gap. In case of hydrodynamic bearing of the slippers, the lifting-off forces caused by the rotational speed augment the lifting-off forces generated by the working pressure. This means, low speed with high working pressure has to be considered when designing the hold down forces generated by the pre-stressed mounting of the guide ball.

In the state of the art there has been a compromise made between these aforementioned opposing requirements, thereby, accepting frequently higher hold down forces at the beginning of rotation in order to keep the gap between the slippers and the swashplate within acceptable limits at high rotational speeds and/or at high work load, i.e. high working pressure. In DE 10 2012 110 853 A1 (JP 2014-095 384 A) a disc spring element is used for this purpose as a hold down device to generate the hold down forces onto the slippers. Thereby, the disc spring element abuts on the guide ball being designed integral with the cylinder block. In DE 1 453 639 C (U.S. Pat. No. 3,191,543 A) a spherical collar is pressed by compression springs against a hold down ring holding down the piston slippers thereby exerting forces of a min. 300 pounds up to 860 pounds are suggested in order to hold the slippers in sliding contact on the sliding surface of the swashplate. In U.S. Pat. No. 4,111,103 a hold down ring is fixed to the swashplate at the radial outer edge of a slipper plate and is used to hold the slipper plate at a fixed distance to the swashplate, thereby allowing the same leakage gap at any operational state of the hydraulic axial piston unit. This gap is previously defined and adjustable by a shim between the slipper plate and the swashplate.

SUMMARY

Therefore, it is an object of the invention to provide a slipper hold down device for hydraulic axial piston units of the swashplate construction type, which enables reduced friction at the beginning of rotation of the driving unit in order to prevent the slippers and the swashplate from wear and damage and to allow a quick rise of rotational speed of the driving unit. At the same time it is an object of the invention to provide optimal lubrication and sliding conditions between the slippers and the swashplate at high rotational speeds and/or high workload on the driving unit, i.e. when the working pressure in the cylinder bores is high. Simultaneously it is an object of the invention to keep any loss due to leakage at a minimum. Thereby the inventive device should be simple in design and simple to place inside any hydraulic axial piston units, nonetheless if these are existing or to be manufactured. Further, the inventive solution should be easy to mount in the unit and should constitute a cost effective and robust solution, wherein the construction of the inventive solution should need a minimum of parts and space.

The object of the invention is achieved by a hydraulic axial piston unit of the swashplate construction type having a drive shaft adapted to drive or be driven by a cylinder block having a plurality of cylinder bores, in which several pistons are moveable in general along the rotational axis of the drive shaft and relative to the cylinder bores, wherein first ends of the pistons protrude outside of the cylinder bores and are slidable fixed by means of slippers to a swashplate, wherein the slippers are held down in a sliding manner on a sliding surface of the swashplate by means of a slipper hold down ring arranged parallel to the sliding surface, and wherein the slipper hold down ring is in a sliding contact with its radial inner surface with a matching surface on a guide ball rotationally fixed on the drive shaft and axially moveable in direction of the rotational axis towards the cylinder block against resilient forces of springs wherein a mounting ring is attached to the cylinder block in order to limit the axial movement of the guide ball towards the cylinder block.

The inventive axial piston unit of the swashplate construction type comprises a drive shaft adapted to drive or to be driven by a cylinder block. The cylinder block comprises a plurality of cylinder bores in which working pistons are movable reciprocally in general along the rotational axis of the drive shaft and relative to the cylinder bores. First ends of the pistons protrude outside of the cylinder bores and comprise commonly a spherical form. These first ends of the pistons are slide-able fixed by means of piston slippers to a swashplate, wherein these slippers are held down in a sliding manner on a sliding surface of the swashplate by means of a slipper hold down ring. This slipper hold down ring is arranged parallel to the sliding surface wherein an inner radial surface is in physical contact with a corresponding matching surface on a guide ball. The guide ball holds down the slipper hold down ring on the slippers and is rotationally fixed on the drive shaft. The guide ball can be moved axially with respect to the drive shaft and the cylinder block in the direction of the rotational axis. Thereby the guide ball is mounted axially pre-stressed by means of springs that abut on the cylinder block, for example, and presses the guide ball towards the swashplate. According to the invention a mounting ring is attached to the cylinder block limiting the relative axial movement of the guide ball towards the cylinder block. The guide ball permanently contacts with its spherical surface the hold-down ring whereas at standstill and/or at low rotational speeds and/or at low working pressure of the drive unit of the hydraulic axial piston unit on the opposite end of the guide ball a gap to the mounting ring is present. Therewith, in operating conditions the size of the gap between the slippers and the swashplate is limited by a physical stopper, here the mounting ring, when the guide ball moves towards the cylinder block. The gap is limited preferably to a distance which allows optimum lubrication either hydro-dynamically or by internal or external lubrication.

Advantageously the maximum size of the gap is limited by a physical stop by means of the mounting ring. Due to this, the spring forces for holding down the hold down ring at standstill and/or at low rotational speeds and/or at low working pressure can be reduced significantly, therewith enabling low friction and low wear conditions and allowing a steep ramp for accelerating the driving unit. At the same time assembly forces are reduced, making the assembly process of the driving unit into hydraulic axial piston unit easier.

Preferably the maximum size of the gap between the slippers and the swashplate can be defined in the design phase of the hydraulic axial piston unit to a size being optimum for lubrication or the creation of a hydrodynamic bearing with a minimum of leakage. Furthermore, preferably the position of the mounting ring can be adjusted according to production and/or assembly tolerances of the hydraulic axial piston unit. Further, preferably the mounting ring distance to the guide ball is adjustable when putting the hydraulic axial piston unit into service and/or in maintenance or service procedures during the life span of the hydraulic axial piston unit.

In a preferred embodiment of the inventive hydraulic axial piston unit a gap between the mounting ring and the guide ball is present, when the hydraulic axial piston unit is at standstill and/or at low rotational speeds and/or at a low working pressure. In this case the guide ball which is moveable relatively to the cylinder block is mounted pre-stressed in axial direction to the cylinder block in such a way that the guide ball is pushed away from the cylinder block. Thereby the spring stroke is limited by the slipper hold down ring abutting with its inner radial surface on the matching surface of the guide ball.

At the same time a minimum force sufficient to reach force balance between the slipper hold down force and a resultant slipper lift-off force is reached already at low pressures and/or low rotational speed conditions. Hence, lubrication conditions as well as friction conditions are optimized compared to the state of the art. This also enables a better response of the hydraulic axial piston unit to a change in working conditions, especially to increasing working pressure and rotational speed requirements.

In a preferred embodiment of the invention, the pistons comprise longitudinal bores for guiding working fluid from the cylinder bores to the slippers in order to create a hydrodynamic bearing between the slippers and the swashplate. In operation of the hydraulic axial piston unit, hydraulic fluid is fed over the longitudinal piston bores onto the sliding surface of the swashplate, i.e. between the slippers and the swashplate. Depending on the working pressure, the slippers are lifted from the swashplate sliding surface according to the force generated by the working pressure and the centrifugal and gyroscopic forces. It is object of the slipper hold down ring to limit the distance/the gap between the slippers and the swashplate. Therefore, in the art, on the radial outer side of the slipper the hold down ring is fixed directly with a gap to the swashplate or large spring forces at the radial inner side are provided to hold down the slippers on the swashplate against the lifting hydrodynamic gyroscopic forces. However, as already mentioned above, if the working pressure and the rotational speed of the hydraulic axial piston units are rising, the hydrodynamic gyroscopic forces and the rotational gyroscopic forces lifting-up the slippers from the swashplates rise too and the gap between the slippers and the swashplate become bigger. This will be prevented by the additional mounting ring on the cylinder block proving a physical stop for the guide ball in its movement towards the cylinder block. Consequently the gap between the swashplate and the slippers is limited in size. Due to this a minimum amount of working fluid get lost only due to leakage, as the gaps between the single sliding surfaces of the slippers and the swashplate are retained at a minimum for ensuring good lubrication conditions at low friction and wear conditions.

On the other hand, the forces holding down the slippers on the swashplate are low enough to ensure as well good lubrication at low working pressure and/or at low rotational speed conditions. This provides for high efficiency of the hydraulic axial piston unit in low pressure and/or low speed conditions. Finally the contradictory hold down force requirements—high hold down forces at high rotational speed and/or high working pressure and low hold down forces at low rotational speed and/or high working pressure—are fulfilled by the inventive slipper hold down device comprising an additional mounting ring fixed to the cylinder block. By means of the mounting ring a physical stopper at the desired end of the moving distance of the guide ball defines the sliding conditions under which high rotational speed and/or high working pressure conditions can be achieved. By means of decoupling the means for holding down the hold down ring from the spring forces pressing the guide ball onto the hold down ring at high workload conditions these spring forces can be reduced to minimum in order to ensure a low friction sliding contact of the slippers on the sliding surface of the swashplate, in low working pressure and/or low rotational speed conditions.

The mounting ring for limiting the axial movement of the guide ball with respect to the cylinder block can be attached to the cylinder block by press fitting, clueing, welding, heating, clamping, crimping or by plastic deformation. Another preferred possibility is to form a shoulder on the cylinder block onto which the mounting ring can abut. In this case, the mounting ring can be secured in axial direction by press fitting or heat shrinking. Nonetheless an axial freely abutting against the shoulder of the mounting ring is possible as well, this however may generate noise during the operation of the hydraulic piston unit. It can be possible as well that a non-fixed mounting ring in axial direction get wedged with the cylinder block, thereby reducing the moveable distance of the guide ball with respect to the cylinder block and thereby reducing the possible gap between the slippers and the swashplate. Reducing this gap endangers the lubrication film between the slippers and the swashplate. However, the mounting ring defines and maintains the maximum permitted moveable axial distance for the guiding ball, which can be set in this shoulder-based-embodiment by selecting mounting rings with different widths depending upon product and assembly tolerances. These tolerances, for instance, are measured before the final assembly and putting into operation of the hydrostatic axial piston unit or during maintenance of a hydraulic axial piston unit. With the latter wear of the involved parts could also be taken into account.

In another embodiment of the invention during the assembly process of the hydraulic axial piston unit a shim (spacer) is placed between the guide ball and the mounting ring, wherein the thickness of the shim corresponds to the size of the gap calculated/predetermined in the design phase of the hydraulic axial piston unit. Consequently the shim (spacer) has to be removed after assembly to guarantee the gap and mobility of the guide ball in axial direction. In a further embodiment the axial position of the mounting ring with respect to the cylinder block or the hold down ring can be adjusted by measuring the involved parts and/or their axial position relative to each other.

The mounting ring is preferably made of metal, rubber or plastic material or of a combination of these materials. The selection of which material should be used for the mounting ring depends upon the hydraulic axial piston unit characteristics, like volumetric size, applicable speed range and/or maximum working pressure, etc. Where appropriate, there is a preferred use of a rubber material in combination with metal or plastic material, for instance, for achieving a resilient characteristic for the axial abutment of the guide ball on the mounting ring, at least in the area onto which the guide ball strokes against the mounting ring. This may be advantageous with hydraulic axial piston pumps which are operated with quickly and frequent changing working pressure and/or with quickly changing rotational speeds.

One can imagine the design of the mounting ring with an resilient material thick enough to push the guide ball in axial direction away from the cylinder block such that the resilient forces for maintaining the sliding contact of slippers onto the swashplate are provided by the mounting ring. In this case, springs or other elastic parts between the guide ball and cylinder block can be omitted, this can lead to an even more cost effective construction.

For a person skilled in the art it is obvious that the cross section of the mounting ring can be selected to any suitable cross section which fits best with the abutment area of the guide ball and which fits best to the design of the cylinder block. There is no limitation for designing the cross section of the mounting ring, however, simple cross sections, as a general rectangular or circular cross section is preferred with regard to cost aspects.

For a person with relevant skills in the art it is obvious that the inventive hydraulic axial piston unit can be of a constant displacement construction type or a variable displacement construction type, i.e. with a fixed inclined swashplate or with a pivot-able swashplate for adjusting the displacement volume of the hydraulic axial piston unit. Also variable displacement units in which the swashplate can be swivelled to positive and negative angles are covered by the inventive idea.

An embodiment of a hydraulic axial piston pump according to the invention is depicted in more detail in the appended drawings which do not delimit the scope of the inventive idea. All features of the disclosed and illustrated embodiment may be combined in any desired combination with one other within the scope of the invention. It is shown in:

DETAILED DESCRIPTION

Figure 1:
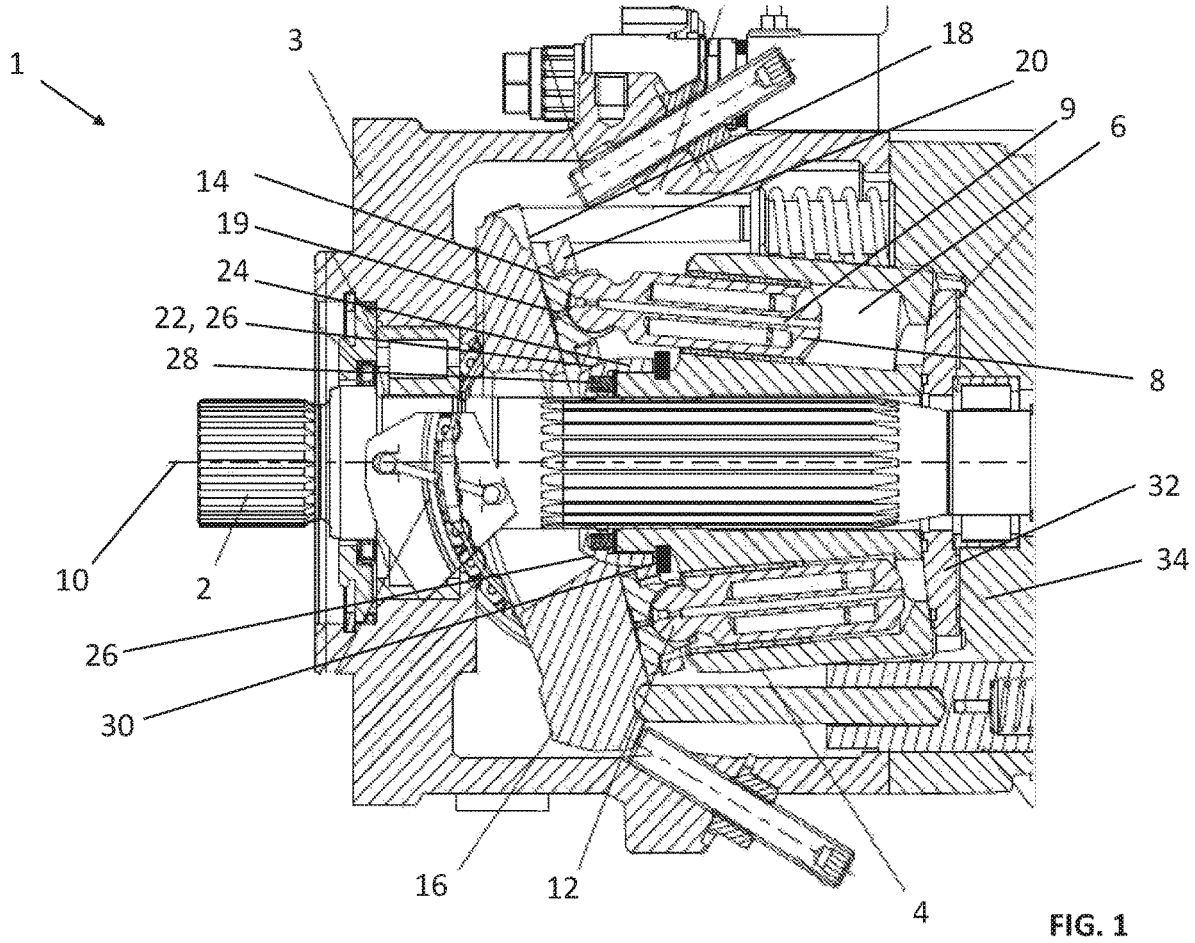
FIG. 1 shows schematically a cross section of a hydraulic axial piston unit.

FIG. 1 shows schematically a cross section of a hydraulic axial piston unit 1 of the swashplate construction type. In a housing 3 of the hydraulic axial piston unit 1 a drive shaft 2 is mounted having a rotational axis 10. The rotational axis 10 defines the axial direction of the hydraulic axial piston pump 1. The drive shaft 2 is adapted to drive or to be driven by a cylinder block 4 having a plurality of cylinder bores 6. In the cylinder bores 6 oriented in general in direction of the rotational axis 10, pistons 8 are accommodated and are movable reciprocally in direction of the cylinder bores 6, i.e. reciprocally in general along the axial direction 10 of the hydraulic axial piston unit 1. First ends of the pistons 8, which protrude outside of the cylinder bores 6 are slide-able fixed by means of piston slippers 14 to a swashplate 16 which does not turn around the drive shaft 2. As the cylinder block 6 turns with the drive shaft 2 the slippers 14 slide on the sliding surface 18 of the swashplate 16. A slipper hold down ring 20 is mounted to prevent the lifting-off of the slippers 14 from the swashplate 16. The slipper hold down ring 20 itself is held in place by a guide ball 24 rotationally secured to the drive shaft 2 and moveable in axial direction of the drive shaft 2. Thereby, the guide ball 24 overlaps partially with the cylinder block 4 and is mounted pre-stressed against the cylinder block 4 via guide ball springs 28 in order to provide elastic forces onto the slipper hold down ring 20 preventing lifting-off of the slippers 14 from the swashplate 16 at standstill and/or at low rotational speeds and/or at a low working pressure of the drive unit of the hydraulic axial piston unit. Near the same end of the guide ball 24 facing the cylinder block 4 a mounting ring 30 is allocated on cylinder block 4 with a distance/gap to the guide ball 24 at the aforementioned conditions of the hydraulic axial piston unit 1.

In operation of the hydraulic axial piston unit 1—working exemplarily as a hydraulic axial piston pump as shown in FIG. 1—working fluid under pressure is guided into the cylinder bores 6 pressing pistons 8 out of cylinder bore 6, therewith initiating the rotation of cylinder block 4. Within the piston 8 a longitudinal bore 9 is provided for guiding hydraulic fluid from cylinder bores 6 to the slippers 14 each of which comprise a lubrication bore 19 for guiding the hydraulic fluid towards the sliding surface 18 on swashplate 16. It can be derived from FIG. 1 that when hydraulic fluid under pressure is guided via the longitudinal bore 9 in piston 8 and via the lubrication bore 19 in slipper 14 onto the sliding surface 18 of the swashplate 16 the slippers 14 are intended to be lifted-off from the sliding surface 18 of the swashplate 16. The slipper hold down ring 20 acts against these lifting forces as it abuts with a radial inner surface 22, against a matching surface 26 on guide ball 24. Guide ball 24 is mounted on drive shaft 2 and elastically abuts in the axial direction on cylinder block 4. In this manner a resilient axial movement of the guide ball 24 is permitted wherein the guide ball 24 is always in contact with its matching surface 26 with the inner radial surface 22 of the hold down ring 20. At least at standstill of the hydraulic axial piston unit 1 a gap between guide ball 24 and the mounting ring 30 is present.

In operation conditions of the hydraulic axial piston unit 1 the gap between the guide ball 24 and the mounting ring 30 can be closed partially, or completely, thereby enabling a corresponding gap between the slippers 14 and the sliding surface 18 on swashplate 16. In this gap between the slippers 14 and the swashplate 16 a lubrication means can enter, preferably hydraulic working fluid under pressure. Mounting ring 30 limits the gap between the slippers 14 and the sliding surface 18 on swashplate 16 by forming a physical stop for the guide ball 24 movement in axial direction towards the cylinder block 4. Hydrostatic and rotational gyroscopic forces lift the slippers 14 from the sliding surface 18 of swashplate 16 and push the hold down ring 20 with its inner radial surface 22 on the matching surface 26 on guide ball 24 and push therewith guide ball 24 towards the mounting ring 30. Finally, in operational conditions of the hydraulic axial piston unit 1 the slippers 14, the slipper hold down ring 20, the guide ball 24, the mounting ring 30, the cylinder block 4 and a valve plate 32 at the opposite end of cylinder block 4 are in continuous physical contact to each other. Furthermore, the mounting ring 30 can be positioned adequately in axial direction of the cylinder block 4 such that the width of the gap between the slippers 14 and the swashplate 16 is optimized for forming optimum lubrication and operational conditions for the drive unit of the hydrostatic axial piston unit 1.

Figure 2:
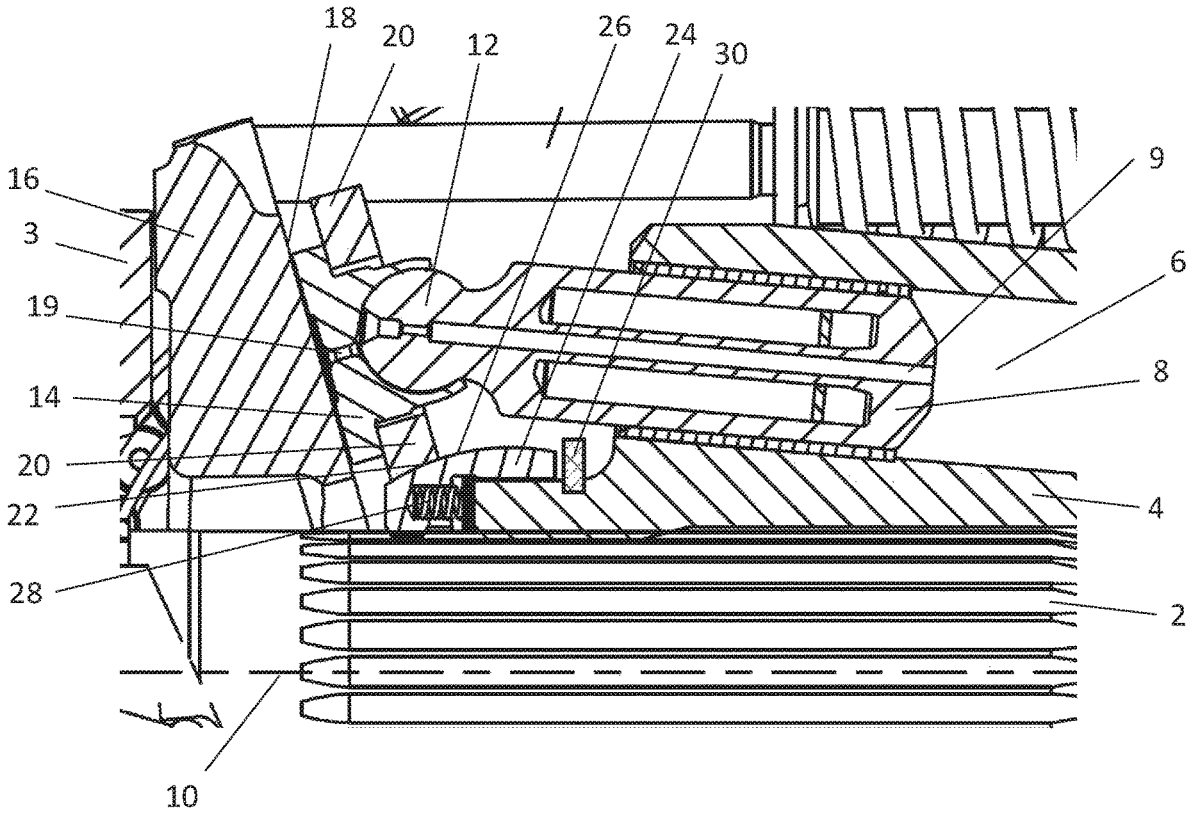
FIG. 2 is an enlarged partial view of the cross section of FIG. 1.

In FIG. 2 an enlarged partial cross section of FIG. 1 is shown with the inventive hydraulic axial piston unit at standstill. From FIG. 2 it can be depicted that springs 28 push the guide ball 24 away from cylinder block 4 and that the slippers 14 are pressed against the sliding surface 18 of swashplate 16 via the matching surface 26 on guide ball 24 and the radial inner surface 22 of the hold down ring 20 by means of the resilient forces of springs 28. Next to the guide ball 24 the mounting ring 30 is fixed with a predefined gap on the cylinder block 4 providing a physical stopper for guide ball 24 when the same is moved in axial direction towards the cylinder block 4. This occurs when hydraulic fluid under pressure via the longitudinal bore 9 in piston 8 and via the lubrication bore 19 in slipper 14 creates a hydraulic force in order to separate the slipper 14 from swashplate 16. While the slipper hold down ring 20 physically engages with its inner radial surface 22 with the matching surface 26 on guide ball 24 the three elements—slipper 14, mounting ring 20 and guide ball 24—are moved in axial direction towards the cylinder block 4 until guide ball 24 abuts against mounting ring 30. This situation occurs in working conditions of the hydraulic axial piston unit, wherein the gap between the slipper 14 and the swashplate 16 is at its maximum when the guide ball 24 touches the mounting ring 30. This maximum gap is maintained constant as long as the working pressure together with the rotational gyroscopic forces exceeds the forces of springs 28. This defined gap provides an optimum size for lubrication between the slippers 14 and sliding surface 18 of swashplate 16.

It can be easily derived, in particular from FIG. 2, that the position of mounting ring 30 defines the size of the gap between the slippers 14 and swashplate 16. In consequence, if the position of mounting ring 30 is adjustable, the gap between slippers 14 and swashplate 16 is adjustable too. This provides for a compensation of production and assembly tolerances of the cylinder block 4, the guide ball 24, the mounting ring 30, the slippers 14 and the swashplate 16. In this tolerance compensation chain, valve plate 32 and end cap 34 on the other side of the cylinder block 4 participate as well, the latter building the opposite end of the drive unit of the hydraulic axial piston unit 1.

In particular from FIG. 2 it can be derived further that an integration of springs 28 in mounting ring 30 forms part of the scope of design possibilities for a person with relevant skills in the art, in order to achieve a resilient abutment of the guide ball 24 on the mounting ring 30. However, it can be preferred for high precision units that the limit of the gap size respectively of the axial movement of the guide ball 24 is performed by a physical stopper, thereby physically limiting the width of the gap between the slippers 14 and the swashplate 16.

Finally, a hydraulic axial piston unit 1 is provided in which optimum lubrication conditions between the slippers (piston slide shoes) and the swashplate 16 at any operational conditions of the hydraulic axial piston unit 1 is achieved in a simple, cost effective and robust manner.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic axial piston unit of the swashplate construction type having a drive shaft adapted to drive or be driven by a cylinder block having a plurality of cylinder bores, each cylinder bore having a piston moveable relative to the cylinder bore, wherein first ends of the pistons protrude outside of the cylinder bores and are slidably attached by means of slippers to a swashplate, wherein the slippers are held down in a sliding manner on a sliding surface of the swashplate by means of a slipper hold down ring arranged parallel to the sliding surface, and wherein the slipper hold down ring is in a sliding contact with its radial inner surface with a matching surface on a guide ball rotationally fixed on the drive shaft and axially moveable in direction of the rotational axis towards the cylinder block against resilient forces of springs;

wherein a mounting ring is attached to the cylinder block by abutting against a shoulder or groove in order to limit the axial movement of the guide ball towards the cylinder block;

wherein a gap between the mounting ring and the guide ball is present when the hydraulic axial piston unit is at a standstill and/or operating at low rotational speeds and/or at low working pressure.

2. The hydraulic axial piston unit according to claim 1, wherein the mounting ring is made of metal, rubber or plastic material or of a combination of these materials.

3. The hydraulic axial piston unit according to claim 2, wherein the mounting ring is resilient in the axial direction.

4. The hydraulic axial piston unit according to claim 1, wherein the mounting ring is resilient in the axial direction.

5. The hydraulic axial piston unit according to claim 1, wherein the mounting ring is of a general rectangular cross section.

6. The hydraulic axial piston unit according to claim 1, wherein the swashplate is suitable to be swiveled with respect to the rotational axis of the drive shaft, in order to adjust the stroke of the pistons.

7. The hydraulic axial piston unit according to claim 1, wherein the gap between the mounting ring and the guide ball is closed partially or completely during operation.

8. The hydraulic axial piston unit according to claim 1, wherein each piston is moveable in the direction of the rotational axis.

* * * * *